US009038315B2

(12) United States Patent
Kellum, III

(10) Patent No.: US 9,038,315 B2
(45) Date of Patent: May 26, 2015

(54) SELF-BALANCING DOUBLE-HUNG WINDOW APPARATUS

(71) Applicant: Caldwell Manufacturing Company North America, LLC, Rochester, NY (US)

(72) Inventor: Wilbur James Kellum, III, Hilton, NY (US)

(73) Assignee: Caldwell Manufacturing Company North America, LLC, Rochester, NY (US)

( * ) Notice: Subject to any disclaimer, the term of this patent is extended or adjusted under 35 U.S.C. 154(b) by 0 days.

(21) Appl. No.: 14/350,296

(22) PCT Filed: Oct. 4, 2012

(86) PCT No.: PCT/US2012/058610

§ 371 (c)(1),
(2) Date: Apr. 7, 2014

(87) PCT Pub. No.: WO2013/052576

PCT Pub. Date: Apr. 11, 2013

(65) Prior Publication Data

US 2014/0230331 A1 Aug. 21, 2014

Related U.S. Application Data

(60) Provisional application No. 61/543,599, filed on Oct. 5, 2011.

(51) Int. Cl.
*E05C 7/06* (2006.01)
*E05D 13/00* (2006.01)
(Continued)

(52) U.S. Cl.
CPC ..... *E05D 13/10* (2013.01); *E05D 13/06* (2013.01); *E05D 15/18* (2013.01); *E05D 15/22* (2013.01); *E05Y 2600/10* (2013.01); *E05Y 2900/148* (2013.01); *E06B 3/4415* (2013.01)

(58) Field of Classification Search
USPC ..... 49/61, 63, 65, 116, 119, 121, 123, 125, 49/127, 128
See application file for complete search history.

(56) References Cited

U.S. PATENT DOCUMENTS 441,019 A * 11/1890 Orbeton ..... 49/121
714,254 A * 11/1902 Streeter ..... 49/121
(Continued)

FOREIGN PATENT DOCUMENTS

AU 2005201313 A1 10/2005

OTHER PUBLICATIONS

International Search Report and Written Opinion of the ISA for PCT/US2012058610, ISA/US, mailed Jan. 2, 2013.

*Primary Examiner* — Katherine Mitchell
*Assistant Examiner* — Catherine A Kelly
(74) *Attorney, Agent, or Firm* — Harness, Dickey & Pierce, P.L.C.

(57) ABSTRACT

A mechanism is provided for balancing and positioning a sash of a self-balancing double-hung window assembly. The mechanism may include a fixed length cable, a pulley, first and second brackets and an adjustment member. The fixed length cable may include first and second ends. The pulley may support the cable. The first bracket may include one or more attachment points relative to the first end of the cable and may include an upper end and a lower end. The second bracket may be movable relative to the first bracket and may be configured to support the sash. The adjustment member may engage and extend through the lower end of the first bracket and may be movable relative to the first bracket to cause corresponding movement of the second bracket relative to the first end of the cable.

6 Claims, 11 Drawing Sheets

(51) Int. Cl.

| | |
|---|---|
| ***E05C 17/62*** | (2006.01) |
| ***E05D 15/22*** | (2006.01) |
| ***E06B 3/44*** | (2006.01) |
| *E05D 15/18* | (2006.01) |

(56) References Cited

U.S. PATENT DOCUMENTS

| | | | | | |
|---|---|---|---|---|---|
| 1,056,348 | A | * | 3/1913 | McClellan | 16/204 |
| 1,119,365 | A | * | 12/1914 | Morris | 49/99 |
| 1,794,746 | A | | 3/1931 | Whitworth | |
| 1,916,681 | A | * | 7/1933 | Nagel | 49/149 |
| 2,098,634 | A | | 11/1937 | Rosenthal | |
| 2,211,473 | A | | 8/1940 | Lyon | |
| 2,266,388 | A | | 12/1941 | Wolff et al. | |
| 2,583,395 | A | | 1/1952 | Skelly | |
| 2,640,222 | A | * | 6/1953 | Trammell, Sr. et al. | 16/202 |
| 3,788,006 | A | * | 1/1974 | Teggelaar et al. | 49/417 |
| 5,099,963 | A | * | 3/1992 | Alchin | 188/136 |
| 5,331,765 | A | * | 7/1994 | Dupuis et al. | 49/121 |
| 6,701,670 | B2 | | 3/2004 | Evans | |
| 7,117,636 | B2 | * | 10/2006 | Gann | 49/123 |
| 7,367,162 | B2 | * | 5/2008 | Lucci | 49/453 |
| 8,448,296 | B2 | * | 5/2013 | Kellum, III | 16/193 |
| 2011/0041287 | A1 | * | 2/2011 | Kellum, III | 16/193 |

* cited by examiner

SELF-BALANCING DOUBLE-HUNG WINDOW APPARATUS

CROSS-REFERENCE TO RELATED APPLICATIONS

This application is a 371 U.S. National Phase of PCT/US2012/058610, filed Oct. 4, 2012, which claims the benefit of U.S. Provisional Application No. 61/543,599, filed on Oct. 5, 2011. The entire disclosures of the above applications are incorporated herein by reference.

FIELD

The present disclosure relates to a self-balancing double-hung window apparatus.

BACKGROUND

This section provides background information related to the present disclosure and is not necessarily prior art.

Modern window assemblies in residential, commercial and industrial buildings may include one or more window sashes that are movable within a window jamb. Some window assemblies may include an upper sash and a lower sash that are connected to each other by a cable engaging a pulley so that when one sash is moved vertically in one direction, the other sash moves vertically in the opposite direction. In this manner, the upper and lower sashes may balance each other to assist a user in moving the window sashes and to retain the window sashes at a position selected by the user.

SUMMARY

This section provides a general summary of the disclosure, and is not a comprehensive disclosure of its full scope or all of its features.

In one form, the present disclosure provides a mechanism for balancing and positioning a sash of a self-balancing double-hung window assembly. The mechanism may include a fixed length cable, a pulley, first and second brackets and an adjustment member. The fixed length cable may include first and second ends. The pulley may support the cable. The first bracket may include one or more attachment points relative to the first end of the cable and may include an upper end and a lower end. The second bracket may be movable relative to the first bracket and may be configured to support the sash. The adjustment member may engage and extend through the lower end of the first bracket and may be movable relative to the first bracket to cause corresponding movement of the second bracket relative to the first end of the cable.

The mechanism may also include a third bracket, a fourth bracket and another adjustment member. The third bracket may be attached to the second end of the cable and may include an upper end and a lower end. The fourth bracket may be movable relative to the third bracket and may be configured to support another sash. The additional adjustment member may engage and extend through the lower end of the third bracket and may be movable relative to the third bracket to cause corresponding movement of the fourth bracket relative to the second end of the cable. Movement of one of the sashes in a first direction causes corresponding movement of the other one of the sashes in a second direction opposite the first direction.

In some embodiments, the adjustment member may threadably engage the first bracket.

In some embodiments, the first bracket may be fixed relative to the first end of the cable.

In some embodiments, the second bracket may include first and second members. The first member may be configured to support the sash. The second member may be fixed relative to the first member.

In some embodiments, the second member may slidably engage the first bracket.

In some embodiments, the first member may slidably engage the first bracket.

In some embodiments, the first bracket may include a post that slidably engages the first member.

In some embodiments, the first and second members of the second bracket may be discrete components that are fixedly secured to each other.

In some embodiments, the mechanism may include a housing supporting the pulley for rotation relative to the housing. The housing may include a body portion and a rib member extending outward from the body portion in a direction substantially parallel to an axis of rotation of the pulley. The rib member may be configured to cooperate with a portion of a window jamb to form a substantially continuous jamb wall.

The housing may include first and second ends and a cavity in which the pulley is rotatably disposed. In some embodiments, the first end may include first and second channels, and the second end may include third and fourth channels. The first, second, third and fourth channels may be in communication with the cavity and may be adapted to receive the cable.

In some embodiments, the rib member extends from the first end to the second end of the housing.

In another form, the present disclosure provides an apparatus for positioning first and second sashes of a window assembly. The apparatus may include a fixed length cable, a pulley and a housing. The fixed length cable may include a first end supporting the first sash and a second end supporting the second sash. The pulley may support the cable. The housing may support the pulley for rotation relative to the housing. The housing may include a body portion and a rib member extending outward from the body portion in a direction substantially parallel to an axis of rotation of the pulley. The rib member may be configured to cooperate with a portion of a window jamb to form a substantially continuous jamb wall.

In another form, the present disclosure provides a self-balanced double-hung window assembly that may include a window frame, a first sash, a second sash, a cable, a pulley and a housing. The window frame may include a dividing member defining a first jamb channel and a second jamb channel. The first sash may be movable within the first jamb channel. The second sash may be movable within the second jamb channel. The cable may include a first end supporting the first sash and a second end supporting the second sash. The pulley may support the cable. The housing may be at least partially disposed within the first and second jamb channels and may support the pulley for rotation relative to the housing. Rotation of the pulley in a first rotational direction may cause corresponding movement of the first sash in a first linear direction, and corresponding movement of the second sash in a second linear direction. The housing may include a body portion and a rib member extending outward from the body portion in a direction substantially parallel to an axis of rotation of the pulley. The rib member may cooperate with the dividing member to form a substantially continuous jamb wall separating the first and second jamb channels.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
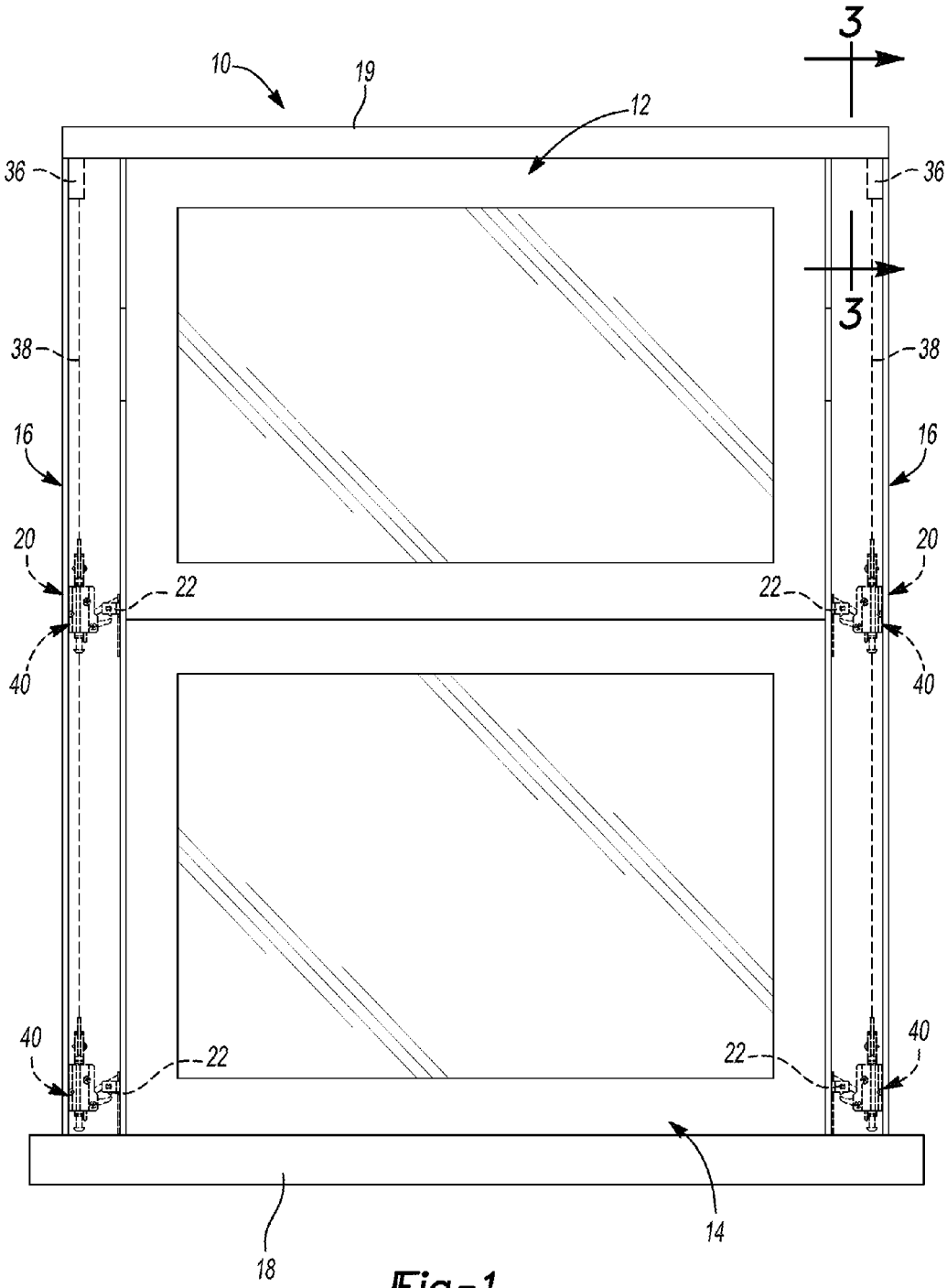
FIG. 1 is a plan view of a window assembly including window balance assemblies according to the principles of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With reference to FIG. 1, a window assembly 10 is provided that may include an upper sash 12, a lower sash 14, a pair of window jambs 16, a window sill 18, a header 19 and a pair of window balance assemblies 20. The upper and lower sashes 12, 14 may be raised and lowered between open and closed positions and may be connected to the window balance assemblies 20 which assist a user in opening the sashes 12, 14 and maintain the sashes 12, 14 in a desired position relative to the window sill 18. The upper and lower sashes 12, 14 are both attached to corresponding pairs of sash brackets 22 (shown in FIGS. 1 and 6) that engage corresponding window balance assemblies 20 to couple the sashes 12, 14 to the window balance assemblies 20.

As will be subsequently described, the window assembly 10 may be a self-balancing double-hung window assembly. That is, the window balance assemblies 20 are connected to the upper and lower sashes 12, 14 such that when the lower sash 14 is moved upward, the upper sash 12 moves an equal distance, but in a downward direction. Likewise, when the lower sash 14 moves downward, the upper sash 12 moves an equal distance, but in an upward direction. In this manner, the weight of the upper sash 12 balances the weight of the lower sash 14.

Figure 2:
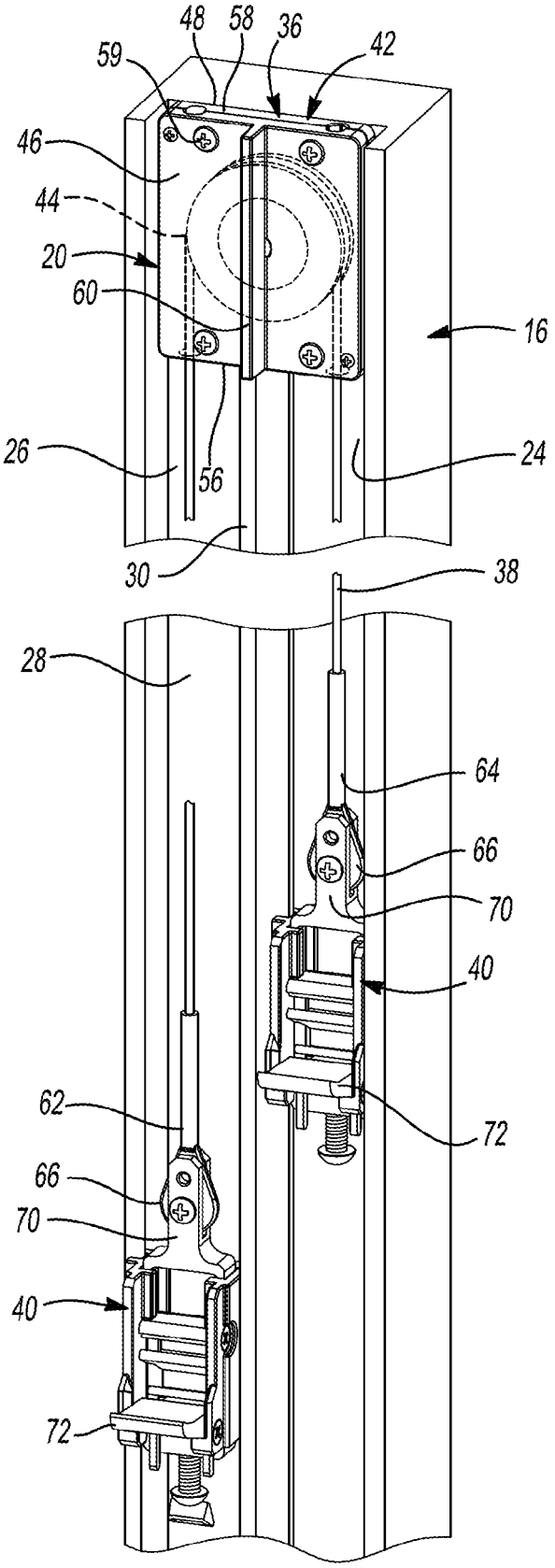
FIG. 2 is a partial perspective view of a window balance assembly installed in a window jamb.
Figure 3:
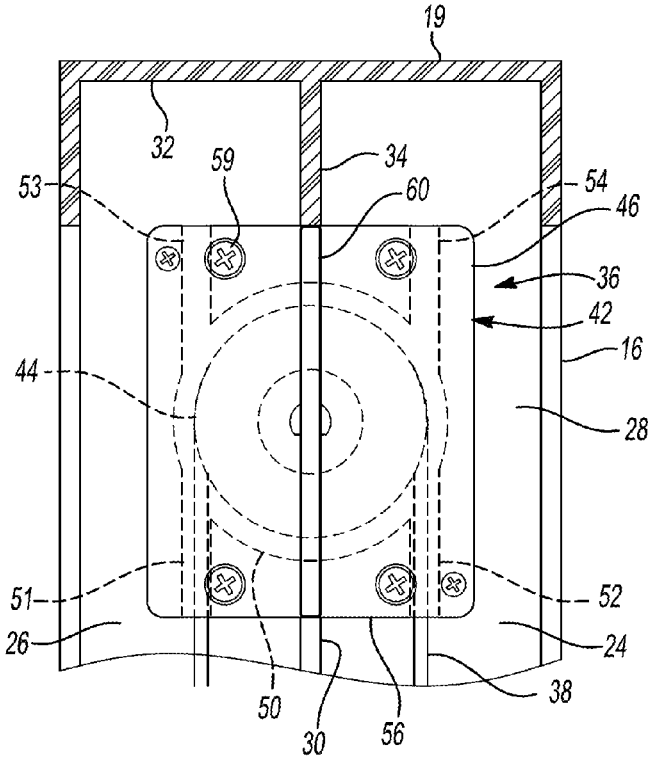
FIG. 3 is a partial cross-sectional view of a pulley assembly mounted in the window jamb taken at line 3-3 of FIG. 1.
Figure 4:
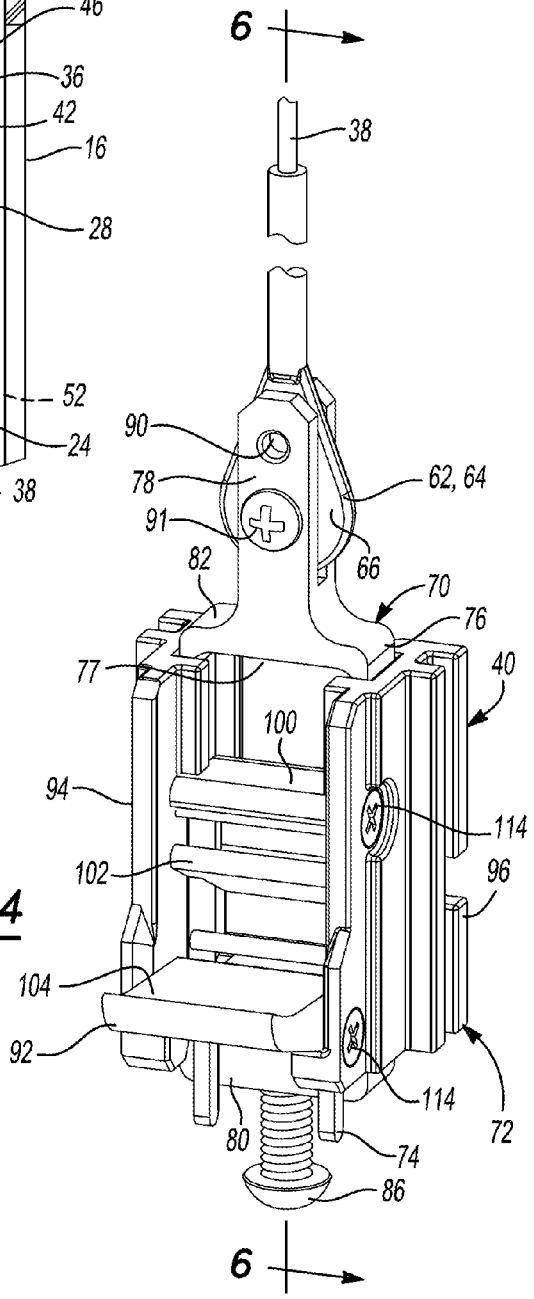
FIG. 4 is a partial perspective view of a cable and a bracket assembly of the window balance assembly.

As shown in FIGS. 2 and 3, each of the window jambs 16 may include a first jamb channel 24 and a second jamb channel 26. As shown in FIG. 2, a side wall 28 of each window jamb 16 includes a vertically extending divider wall 30. As shown in FIG. 3, a top wall 32 of the header 19 includes a horizontally extending divider wall 34. The divider walls 30, 34 define the first and second jamb channels 24, 26. The upper sash 12 may slide up and down between open and closed positions in the first jamb channel 24, and the lower sash 14 may slide up and down between open and closed positions in the second jamb channel 26.

Referring now to FIGS. 1-3, each of the window balance assemblies 20 may include a pulley assembly 36, a fixed length cable 38 and a pair of bracket assemblies 40. The pulley assembly 36 may include a pulley housing 42 and a pulley wheel 44, as shown in FIGS. 2 and 3. The pulley housing 42 may include a first housing portion 46 and a second housing portion 48 that are fixed to each other via fasteners, a snap-fit, adhesive bonding and/or ultrasonic welding, for example. As shown in FIG. 3, the first and second housing portions 46, 48 may cooperate to define a cavity 50 and first, second, third and fourth channels 51, 52, 53, 54 in communication with the cavity 50. The first and second channels 51, 52 may extend from the cavity 50 through a first end 56 of the pulley housing 42. The third and fourth channels 53, 54 may extend from the cavity 50 through a second end 58 of the pulley housing 42. The third and fourth channels 53, 54 can be provided so that either of the first and second ends 56, 58 of the pulley housing 42 can be the top end and either can be the bottom end, thereby reducing the likelihood of the pulley housing 42 being incorrectly installed in the window jamb 16.

The pulley housing 42 may be fixed to the side wall 28 of the window jamb 16 by a plurality of fasteners 59. The pulley wheel 44 may be disposed inside of the cavity 50 and may be rotatably supported by the first and/or second housing portions 46, 48. The cable 38 may engage the pulley wheel 44 and extend through the pair of channels 51, 52 or 53, 54 that are facing downward (i.e., the first and second channels 51, 52 in the orientation shown in FIG. 2). It will be appreciated that in some embodiments, the pulley assembly 36 could include a plurality of pulley wheels 44 or a compound pulley system to provide a desired mechanical advantage.

The first housing portion 46 may include a rib 60 that protrudes outward and extends from the first end 56 to the second end 58 of the pulley housing 42. As shown in FIGS. 2 and 3, when the pulley housing 42 is installed in the window assembly 10, the rib 60 may be aligned with and abutting against the divider walls 30, 34 of the window jamb 16 and header 19, respectively. In this manner, the divider walls 30, 34 and the ribs 60 of both pulley housings 42 cooperate to provide a continuous divider between the first and second jamb channels 24, 26 to restrict or prevent the passage of air, moisture and/or debris between the first and second jamb channels 24, 26.

Referring now to FIGS. 2 and 4-8, the fixed length cable 38 may be a flexible member including first and second ends 62, 64. The first and second ends 62, 64 both may include a grommet or other connector 66 having an aperture 68 (FIG. 5) extending therethrough. The connectors 66 are attachable to corresponding bracket assemblies 40, as shown in FIG. 2. The cable 38 can be a braided metallic material, for example, or any other suitable material and/or type of cable.

Referring now to FIGS. 4-8, each of the bracket assemblies 40 may include a bridle or first bracket 70, a second bracket 72, and a pivoting anchor bracket 74. The first bracket 70 can be formed from a metallic material, for example, and may include a generally rectangular frame portion 76 and a connector portion 78. The frame portion 76 may include lower and upper ends 80, 82 and a pair of parallel arms 83 (FIG. 5) extending therebetween to define an opening 77. The lower end 80 may include a threaded aperture 84 extending therethrough. As shown in FIGS. 4 and 6-8, a threaded adjustment bolt 86 may movably engage the threaded aperture 84.

Figure 5:
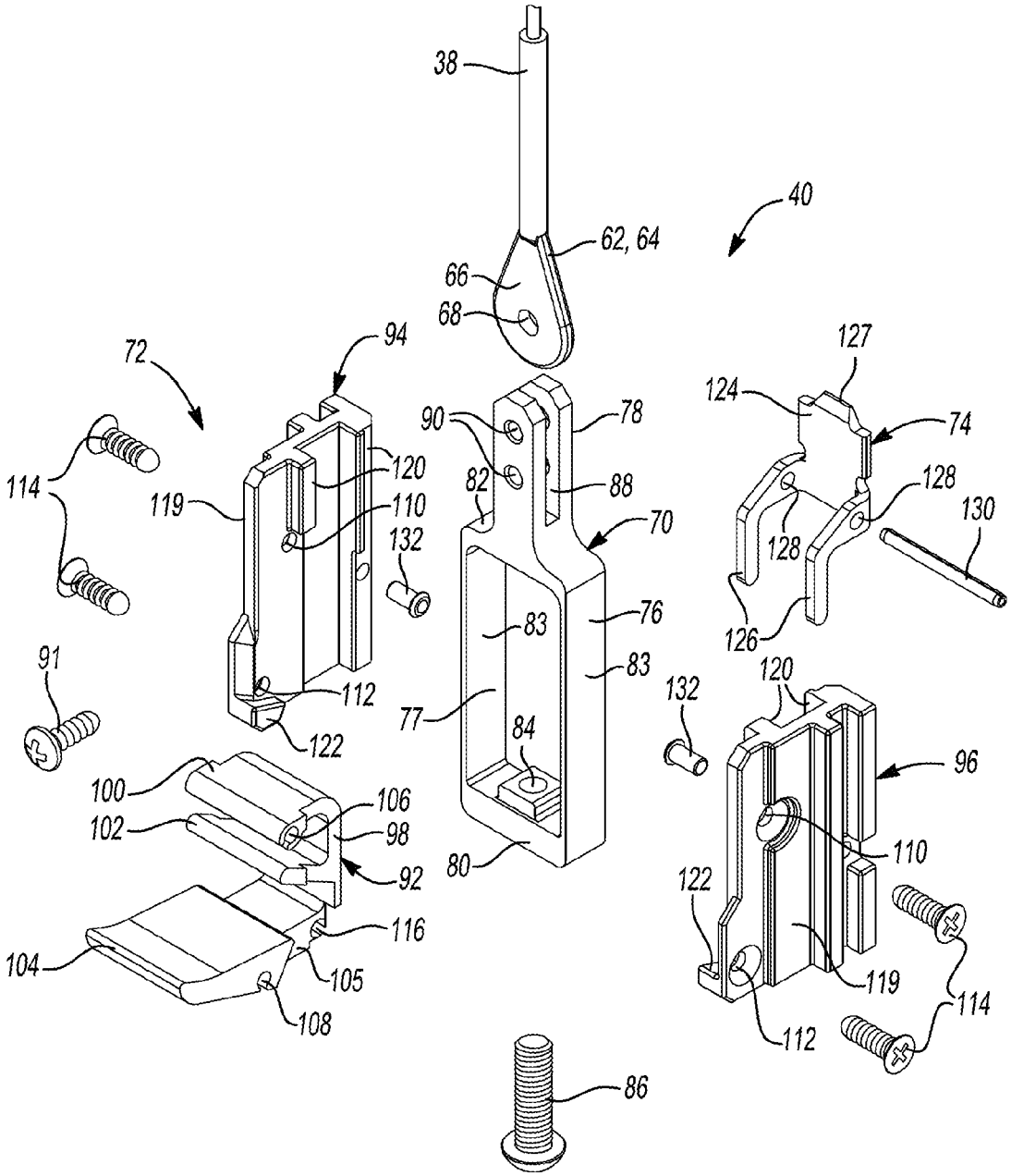
FIG. 5 is an exploded perspective view of the cable and bracket assembly of FIG. 4.

The connector portion 78 may extend upward from the upper end 82 of the frame portion 76 and may include a slot 88 and a pair of apertures 90 (FIG. 5). The connector 66 of the cable 38 may be received in the slot 88 and positioned therein such that the aperture 68 of the connector 66 is aligned with one of the apertures 90 in the connector portion 78. A fastener 91 may extend through the aligned apertures 68, 90 to fixedly secure the connector 66 to the first bracket 70. The particular one of the apertures 90 utilized to attach the connector 66 may be chosen based on the size and/or configuration of the window assembly 10 in which the window balance assembly 20 is installed. That is, if a shorter distance between the end 62, 64 of the cable 38 and the second bracket 72 is desired, the lower one of the apertures 90 may be selected. Alternatively, if a longer distance between the end 62, 64 of the cable 38 and the second bracket 72 is desired, the upper one of the apertures 90 may be selected. As will be subsequently described, fine-tuning of the distance between the end 62, 64 of the cable 38 and the second bracket 72 can be achieved by moving the adjustment bolt 86.

The second bracket 72 may include a first member 92, a second member 94 and a third member 96. The first member 92 may be clamped between and fixedly attached to the second and third members 94, 96. The second and third members 94, 96 may slidably engage the frame portion 76 of the first bracket 70. The first member 92 may support a corresponding sash 12, 14.

Figure 6:
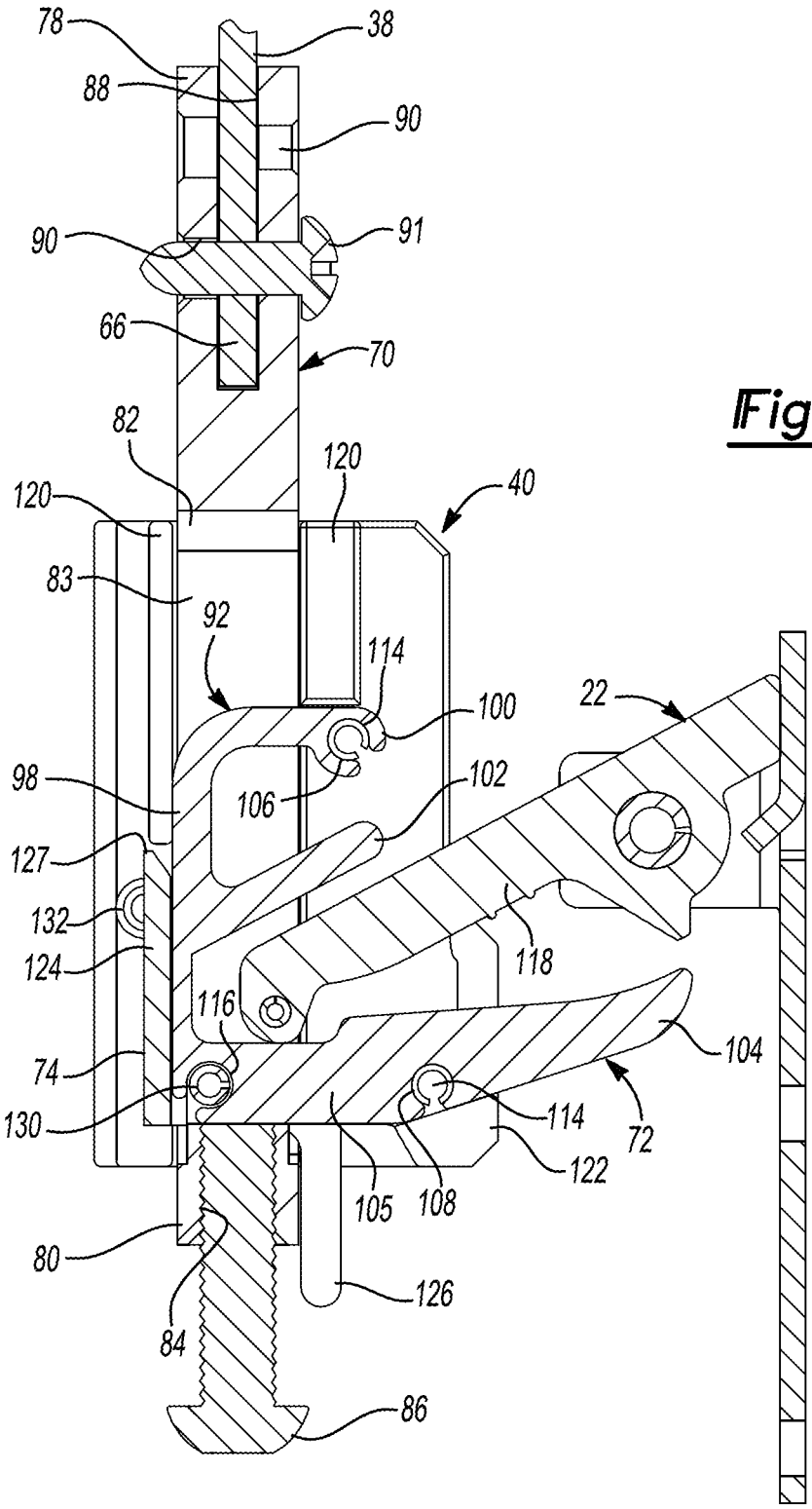
FIG. 6 is a cross-sectional view of the cable and bracket assembly taken at line 6-6 of FIG. 4.
Figure 7:
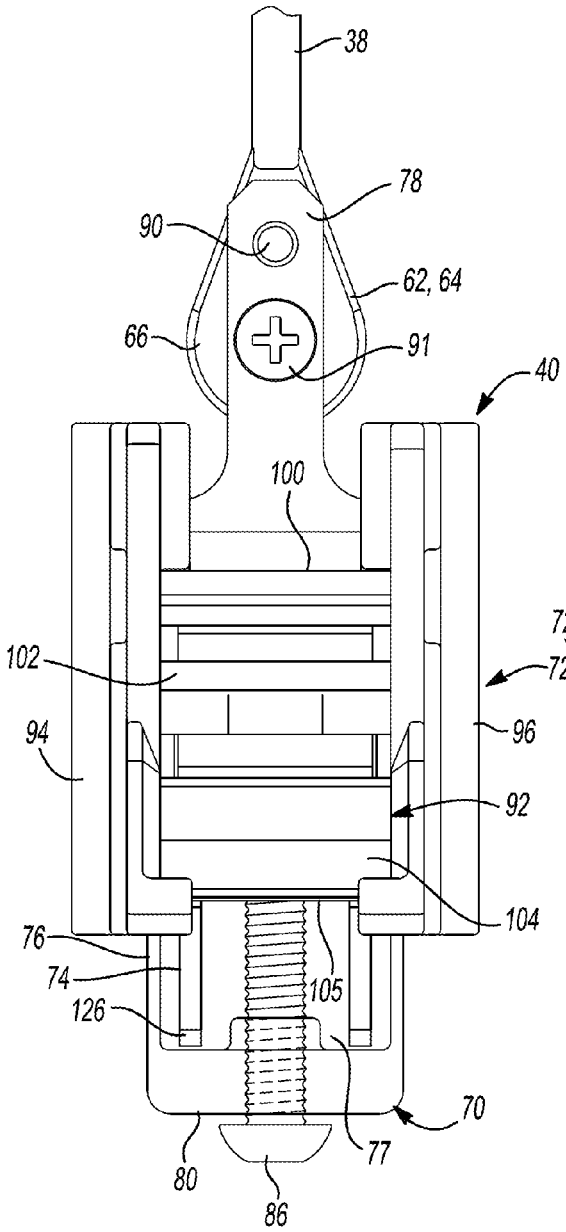
FIG. 7 is a front view of the cable and bracket assembly in a first position according to the principles of the present disclosure.
Figure 8:
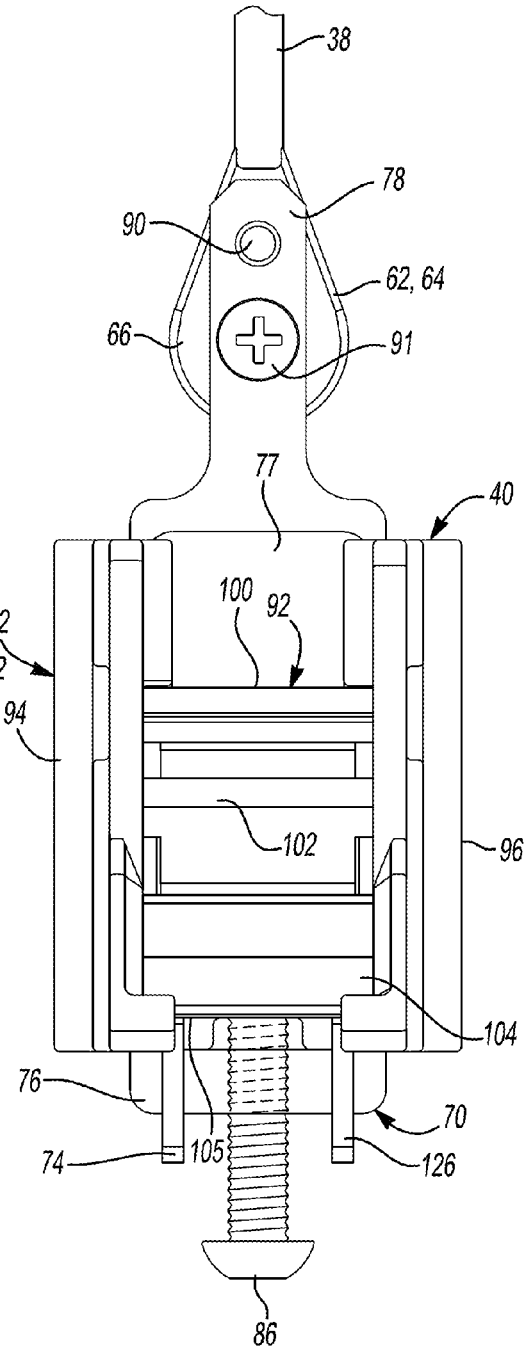
FIG. 8 is a front view of the cable and bracket assembly in a second position according to the principles of the present disclosure.
Figure 9:
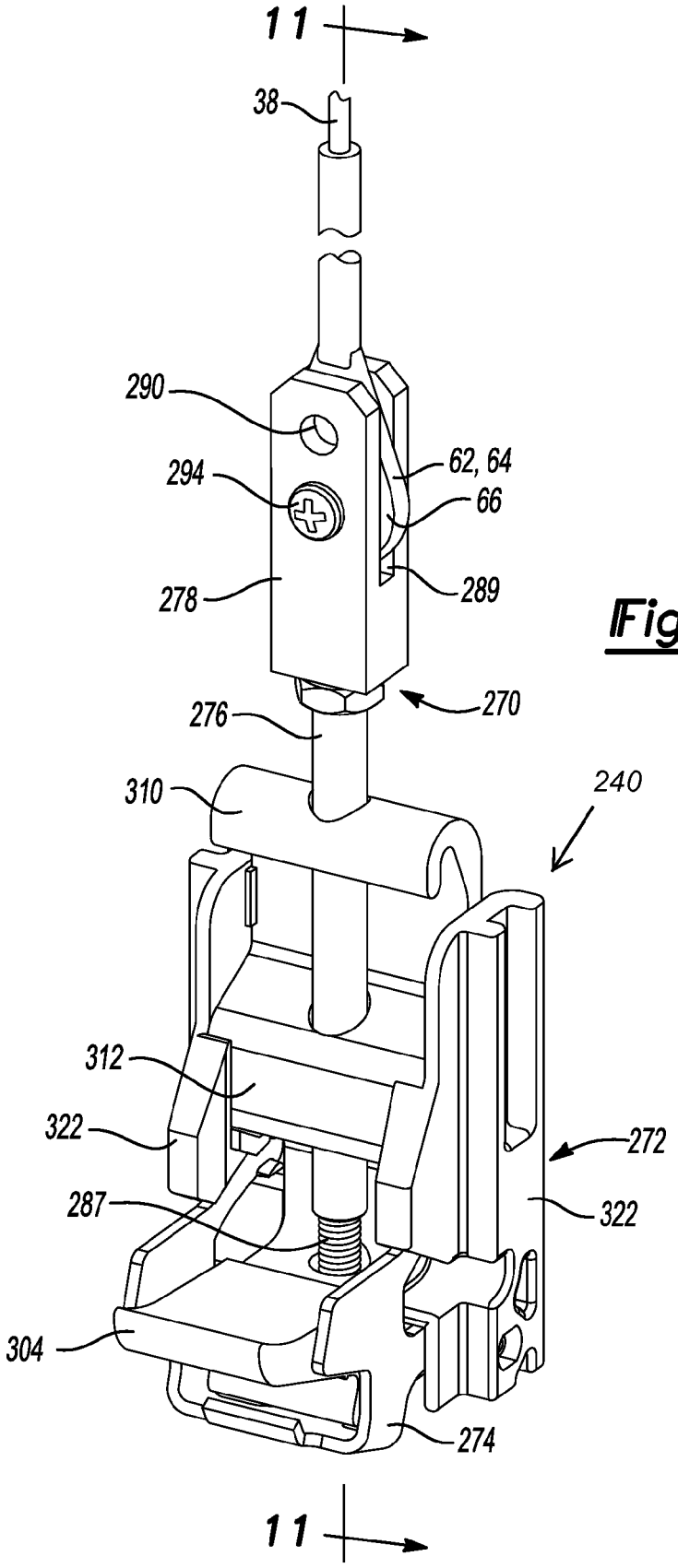
FIG. 9 is a partial perspective view of the cable and another bracket assembly according to the principles of the present disclosure.
Figure 10:
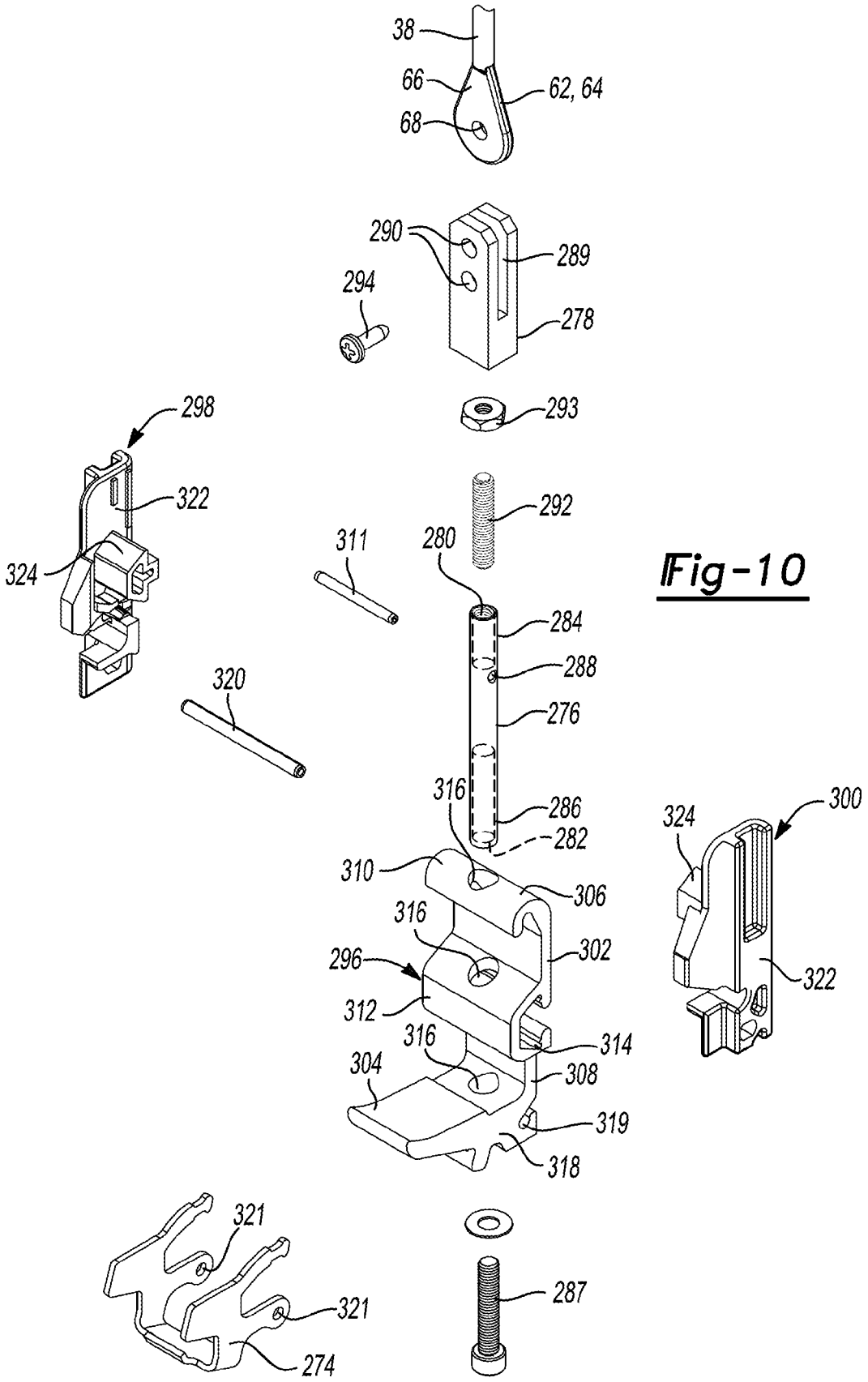
FIG. 10 is an exploded perspective view of the cable and bracket assembly of FIG. 9.

The first member 92 may be formed from a metallic material, for example, and may include a body 98 and first, second and third arms 100, 102, 104 extending generally horizontally from the body 98. The body 98 and at least portions of the arms 100, 102, 104 may be movably received in the opening 77 of the first bracket 70. The first arm 100 and the third arm 104 may include mounting apertures 106, 108, respectively. The apertures 106, 108 may be aligned with corresponding apertures 110, 112 in the second and third members 94, 96. Fasteners 114 may engage the apertures 106, 110 and 108, 112, respectively, to secure the second and third members 94, 96 to the first member 92. A base 105 of the third arm 104 may include a hinge aperture 116. As shown in FIGS. 6-8, the base 105 of the third arm 104 is in contact with an end of the adjustment bolt 86. As shown in FIG. 6, a pivoting arm 118 of the sash bracket 22 may be received between the second and third arms 102, 104 and may be supported by the third arm 104.

The second and third members 94, 96 may be substantially identical to each other, but mirror images of each other. The second and third members 94, 96 may be formed from a polymeric material, for example, and may each include a body 119, a pair of rails 120, and a support lip 122 (shown in FIG. 5). The rails 120 cooperate to define channels in which the arms 83 of the first bracket 70 are slidably received. The support lips 122 provide support for the third arm 104 of the first member 92, as shown in FIG. 6.

With reference to FIGS. 5 and 6, the pivoting anchor bracket 74 may be pivotably attached to the first member 92 of the second bracket 72. The pivoting anchor bracket 74 may be operable to selectively lock the bracket assembly 40 in the corresponding jamb channel 24, 26 so that the corresponding sash 12, 14 can be removed from the bracket assembly 40 for maintenance or replacement, for example. The pivoting anchor bracket 74 may include a main body 124 and a pair of parallel legs 126. The main body 124 may include a tab 127 extending upward therefrom. The legs 126 may include hinge apertures 128 that are aligned with the hinge aperture 116 in the first member 92 of the second bracket 72. A hinge pin 130 extends through the hinge apertures 116, 128 and allows the anchor bracket 74 to pivot relative to the first member 92 of the second bracket 72 between an unlocked position (shown in FIG. 6) and a locked position (not shown) in which the tab 127 engages a corresponding latch (not shown) in the window jamb 24, 26. When the tab 127 engages the corresponding latch in the window jamb 24, 26, the bracket assembly 40 may be locked in place relative to the window jamb 24, 26 for removal of the sash 12, 14, as described above. Spring plungers 132 may releasably engage the main body 124 to releasably retain the anchor bracket in the unlocked position.

With reference to FIGS. 1-8, operation of the window assembly 10 will be described in detail. As described above, the window balance assemblies 20 are connected to the upper and lower sashes 12, 14 such that movement of one of the sashes 12, 14 causes equal and opposite movement of the other sash 12, 14. That is, one of the bracket assemblies 40 in each window balance assembly 20 supports the upper sash 12 and the other bracket assembly 40 in each window balance assembly 20 supports the lower sash 14. Accordingly, when the lower sash 14 is moved upward, the upper sash 12 moves an equal distance, but in a downward direction. Likewise, when the lower sash 14 moves downward, the upper sash 12 moves an equal distance, but in an upward direction. In this manner, the weight of the upper sash 12 balances the weight of the lower sash 14.

When the window assembly 10 is being installed, distances between the ends 62, 64 of the cable 38 and corresponding third arms 104 of the first members 92 of the second bracket 72 may be adjusted to accommodate different sizes of sashes 12, 14. Coarse adjustment may be achieved by selecting one of the apertures 90 to utilize in attaching the first bracket 70 to the connector 66 of the cable 38, as described above. Fine adjustment may be achieved by turning the adjustment bolt 86 relative to the first bracket 70 to adjust an amount that the adjustment bolt 86 extends into the opening 77 of the first bracket 70. As shown in FIGS. 7 and 8, moving the adjustment bolt 86 toward the position shown in FIG. 8 (i.e., backing the head of the adjustment bolt 86 away from the first bracket 70) causes the second bracket 72 to move downward relative to the end 62, 64 of the cable 38, thereby increasing the effective length of the assembly 20 (i.e., increasing a distance from one bracket assembly 40, up to the pulley wheel 44, and back down to the other bracket assembly 40). Moving the adjustment bolt 86 toward the position shown in FIG. 7 (i.e., moving the head of the adjustment bolt 86 toward the first bracket 70) causes the second bracket 72 to move upward relative to the end 62, 64 of the cable 38, thereby decreasing the effective length of the assembly 20 (i.e., decreasing the distance from one bracket assembly 40, up to the pulley wheel 44, and back down to the other bracket assembly 40).

Figure 12:
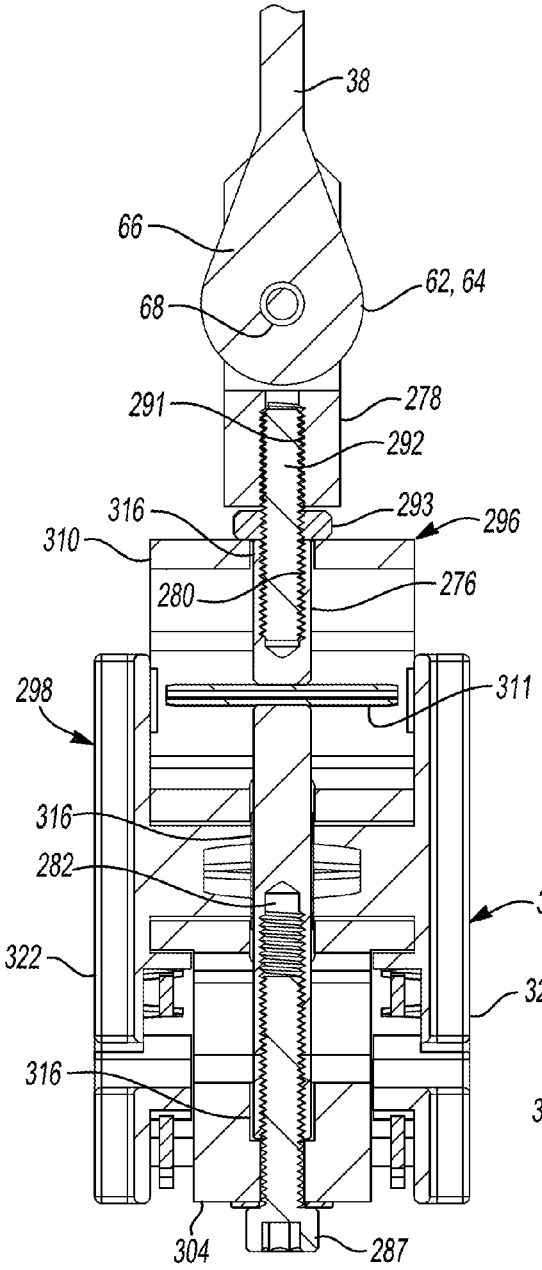
FIG. 12 is another cross-sectional view of the cable and bracket assembly of FIG. 9 in a first position according to the principles of the present disclosure.
Figure 13:
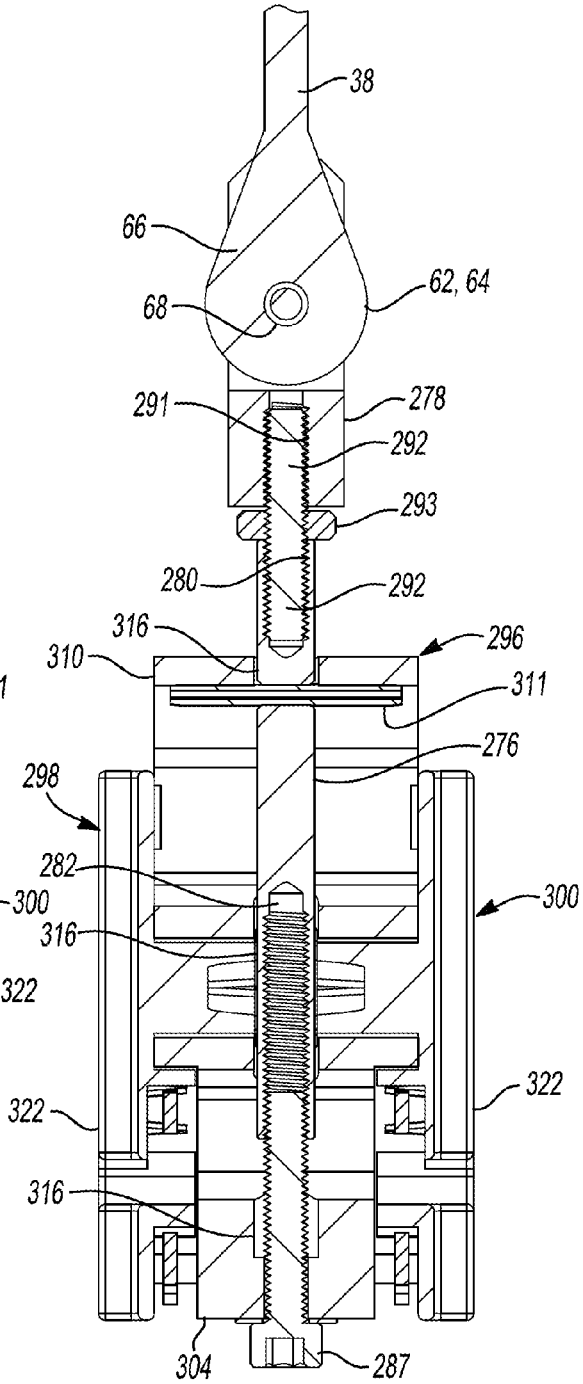
FIG. 13 is a cross-sectional view of the cable and bracket assembly of FIG. 9 in a second position according to the principles of the present disclosure.
Figure 14:
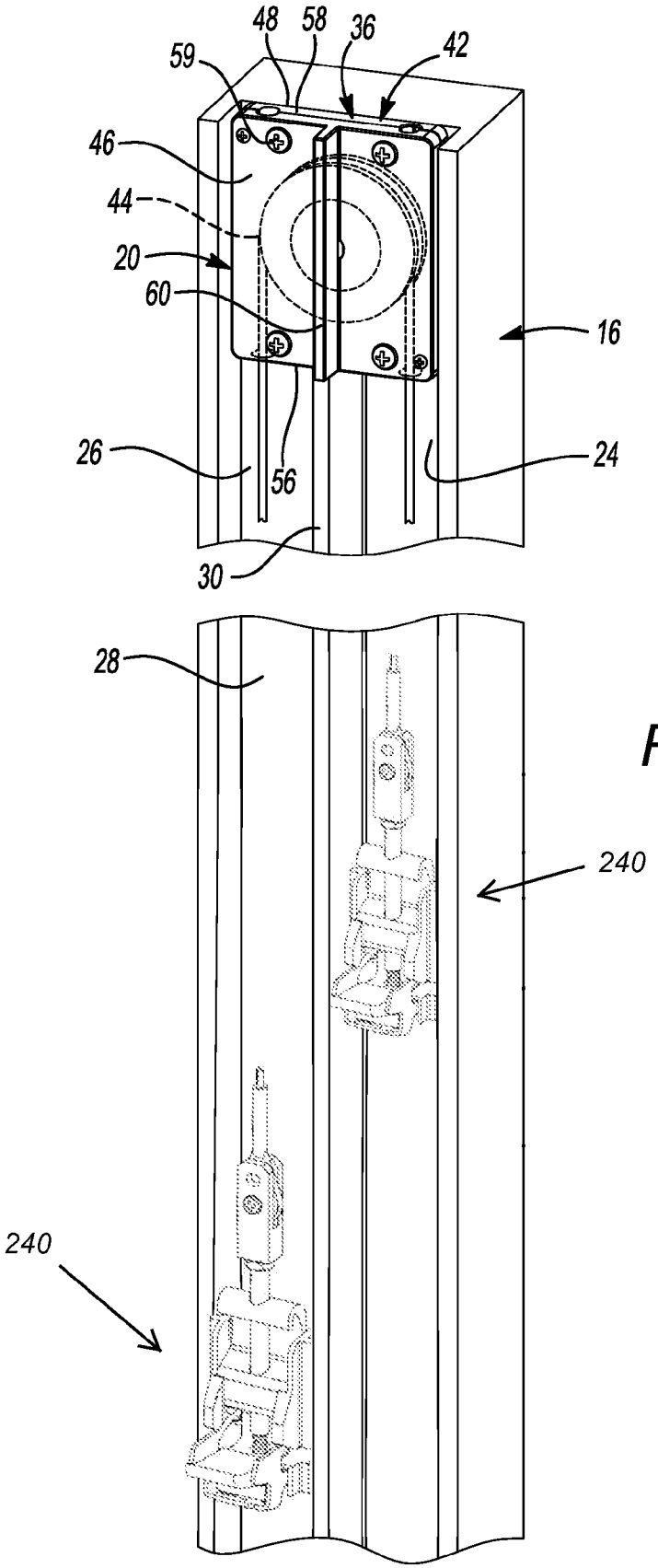
FIG. 14 is a partial perspective view of an alternate configuration of a window balance assembly according to the principles of the present disclosure installed in a window jamb.

With reference to FIGS. 9-14, another bracket assembly 240 is provided. Two of the bracket assemblies 240 may be incorporated into each of the window balance assemblies 20 described above in place of the bracket assemblies 40, as illustrated in FIG. 14. Each of the bracket assemblies 240 may include a first bracket 270, a second bracket 272, and a pivoting anchor bracket 274. The first bracket 270 may fixedly engage the cable 38. The second bracket 272 may slidably engage the first bracket 270 and a position of the second bracket 272 may be adjustable relative to the first bracket 270. The pivoting anchor bracket 274 may be selectively pivotable relative to the first and second brackets 270, 272 to selectively lock and unlock the bracket assembly 240 relative to the window jamb 16 to allow for removal of the sash 12, 14 supported by the bracket assembly 240, in a similar manner as described above.

The first bracket 270 may include a post 276 and a connector portion 278. The post 276 may be an elongated metallic rod having first and second axially extending threaded apertures 280, 282 at first and second ends 284, 286, respectively. An adjustment bolt 287 may threadably engage the second threaded aperture 282 and may be movable therein to adjust a position of the second bracket 272 relative to the first bracket 270, as will be subsequently described. A pin hole 288 may extend laterally through the post 276 proximate the first threaded aperture 280.

The connector portion 278 of the first bracket 270 can be a metallic block, for example, and may include a slot 289 and a pair of apertures 290 extending therethrough. The connector portion 278 may also include a threaded aperture 291 (FIGS. 11-13) that is axially aligned with the first threaded aperture 280 in the post 276. A set screw 292 may threadably engage the threaded apertures 280, 291 to fixedly secure the connector portion 278 to the post 276. A nut 293 may engage the set screw 292, the connector portion 278 and post 276. It will be appreciated that the connector portion 278 and post 276 could be attached to each other in any suitable manner. In some embodiments, the connector portion 278 and post 276 could be integrally formed as a single component.

A fastener 294 may extend through the aligned apertures 68, 290 of the cable 38 and connector portion 278, respectively, to fixedly secure the cable 38 to the first bracket 270. The particular one of the apertures 290 utilized to attach the cable 38 may be chosen based on the size and/or configuration of the window assembly 10 in which the window balance assembly 20 is installed. That is, if a shorter distance between the end 62, 64 of the cable 38 and the second bracket 272 is desired, the lower one of the apertures 290 may be selected. Alternatively, if a longer distance between the end 62, 64 of the cable 38 and the second bracket 272 is desired, the upper one of the apertures 290 may be selected. As will be subsequently described, fine-tuning of the distance between the end 62, 64 of the cable 38 and the second bracket 272 can be achieved by moving the adjustment bolt 287.

The second bracket 272 may include a first member 296, a second member 298 and a third member 300. The first member 296 may be clamped between and fixedly attached to the second and third members 298, 300. The first member 296 may slidably engage the post 276 of the first bracket 270 and may support the weight of a corresponding sash 12, 14.

Figure 11:
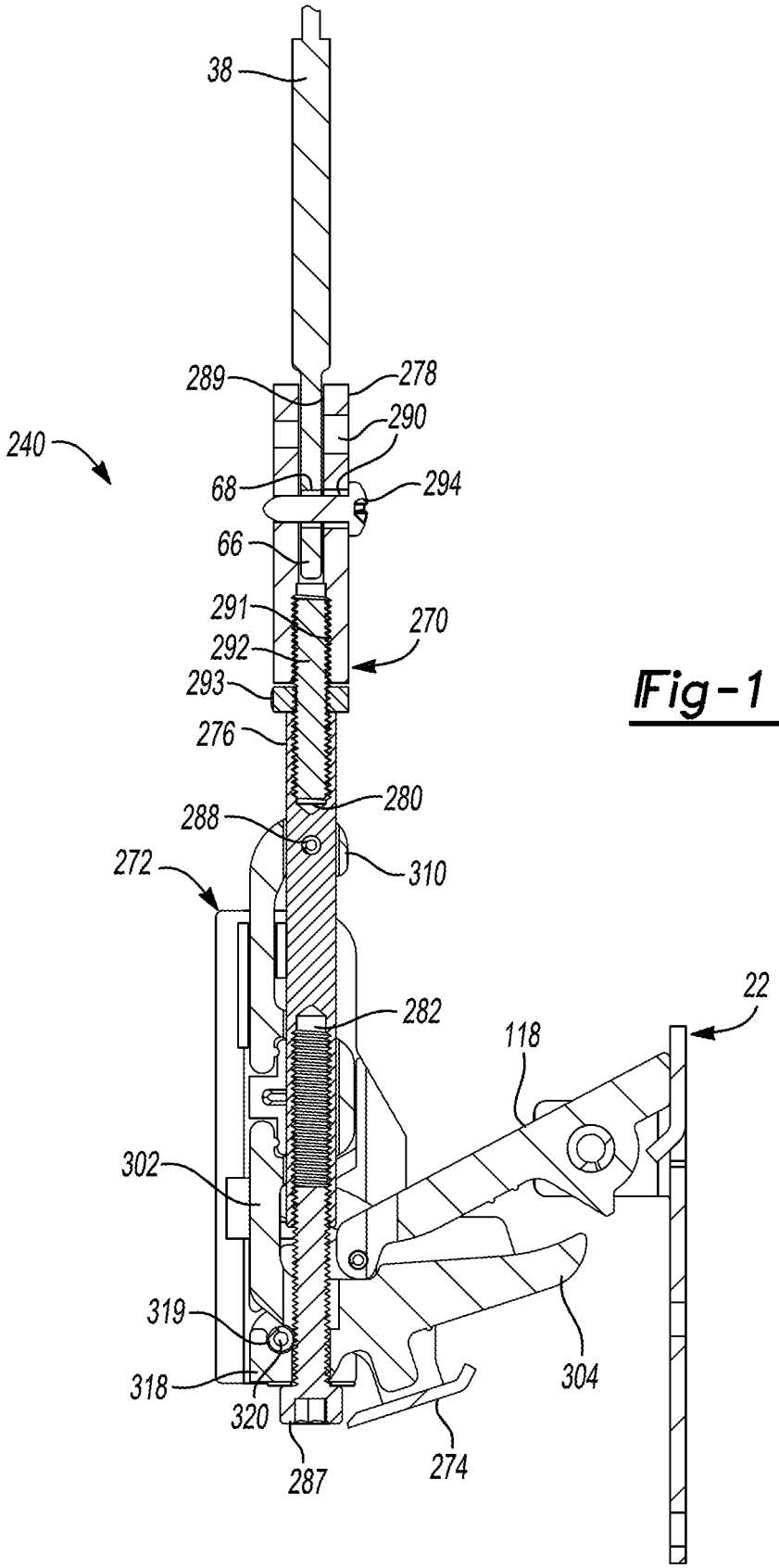
FIG. 11 is a cross-sectional view of the cable and bracket assembly taken at line 11-11 of FIG. 9.

The first member 296 may be formed from a metallic material, for example, and may include a body 302 and an arm 304. The body 302 may include first and second ends 306, 308. The first end 306 may include a hook portion 310. When the second bracket 272 is in the position shown in FIG. 13, the hook portion 310 may engage a pin 311 that may be pressed into engagement with the pin hole 288 of the post 276. The arm 304 may extend laterally outward from the second end 308. As shown in FIG. 11, the arm 304 may support the pivoting arm 118 of the sash bracket 22. A base 318 of the arm 304 may include a hinge pin aperture 319 extending laterally therethrough. The hinge pin aperture 319 may receive a hinge pin 320 that engages apertures 321 in the anchor bracket 274 to support the anchor bracket 274 for pivotable motion relative to the first and second brackets 270, 274.

A boss 312 may be formed on the body 302 between the first and second ends 306, 308. The boss 312 may define a channel 314 (shown in FIG. 10) that extends therethrough. The hook portion 310, the boss 312 and the base 318 of the arm 304 may include apertures 316 extending therethrough and axially aligned with each other. The apertures 316 may slidably receive the post 276 of the first bracket 270.

The second and third members 298, 300 of the second bracket 272 may be substantially identical to each other, but mirror images of each other. Each of the second and third members 298, 300 may include a body 322 and a protrusion 324 (FIG. 10) extending therefrom. The protrusions 324 of the second and third members 298, 300 may be pressed into the channel 314 of the first member 296 to fixedly secure the second and third members 298, 300 relative to the first member 296. Additionally or alternatively, the second and third members 298, 300 could be bolted, adhesively bonded and/or otherwise secured to the first member 296. The polymeric material of the second and third members 298, 300 may reduce friction between the bracket assembly 240 and the jamb channel 24, 26 in which it is installed.

With reference to FIGS. 9-13, operation of the bracket assembly 240 will be described in detail. The bracket assemblies 240 can be incorporated into the window balance assemblies 20 described above in place of the bracket assemblies 40. As described above, the window balance assemblies 20 are connected to the upper and lower sashes 12, 14 such that movement of one of the sashes 12, 14 causes equal and opposite movement of the other sash 12, 14. That is, one of the bracket assemblies 240 in each window balance assembly 20 supports the upper sash 12 and the other bracket assembly 240 in each window balance assembly 20 supports the lower sash 14. Accordingly, when the lower sash 14 is moved upward, the upper sash 12 moves an equal distance, but in a downward direction. Likewise, when the lower sash 14 moves downward, the upper sash 12 moves an equal distance, but in an upward direction. In this manner, the weight of the upper sash 12 balances the weight of the lower sash 14.

When the window assembly 10 is being installed, distances between the ends 62, 64 of the cable 38 and corresponding arms 304 of the first members 296 of the second bracket 272 may be adjusted to accommodate different sizes of sashes 12, 14. Coarse adjustment may be achieved by selecting one of the apertures 290 to utilize in attaching the first bracket 270 to the connector 66 of the cable 38, as described above. Fine adjustment may be achieved by turning the adjustment bolt 287 relative to the first bracket 270 to adjust an amount that the adjustment bolt 287 extends into the second threaded aperture 282 of the post 276. Moving the adjustment bolt 287 further into the second threaded aperture 282 (as shown in FIG. 12) causes the second bracket 272 to move upward relative to the end 62, 64 of the cable 38, thereby decreasing the effective length of the assembly 20 (i.e., decreasing a distance from one bracket assembly 240, up to the pulley wheel 44, and back down to the other bracket assembly 240). Moving the adjustment bolt 287 toward the position shown in FIG. 7 (i.e., backing the head of the adjustment bolt 86 away from the cable 38) causes the second bracket 272 to move downward relative to the end 62, 64 of the cable 38, thereby increasing the effective length of the assembly 20 (i.e., increasing a distance from one bracket assembly 240, up to the pulley wheel 44, and back down to the other bracket assembly 240).

As shown in FIG. 13, the pin 311 and hook portion 310 may cooperate to establish a lowest position to which the second bracket 272 may be adjusted relative to the first bracket 270. That is, interference between the hook portion 310 and the pin 311 may prevent the first member 296 of the second bracket 272 from sliding any further downward along the post 276. In this manner, if a user moves the adjustment bolt 287 to a point at which the adjustment bolt 287 is no longer threadably engaged with the post 276, the second bracket 272 will not fall off of the post 276 and become disconnected from the rest of the balance assembly 20.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A mechanism for balancing and positioning a sash of a double hung window assembly within the window jamb of a window frame, the mechanism comprising:

a fixed length cable having first and second ends;

a pulley supporting the cable, the pulley rotatably mounted in a housing, the housing comprising a rib member protruding from a surface of the housing inward toward the sash and extending in a direction substantially parallel to the window jamb to align with a divider wall of the window jamb;

a first bracket attached to the first end of the cable and including an upper end and a lower end;

a second bracket movable relative to the first bracket and configured to support the sash; and an adjustment member engaging the first bracket and being movable relative to the first bracket to cause corresponding movement of the second bracket relative to the first end of the cable;

wherein the second bracket includes first and second members, the first member being configured to support the sash, the second member being fixed relative to the first member; and wherein the first member slidably engages the first bracket.

2. The mechanism of claim 1, wherein the first bracket includes a post that slidably engages the first member.

3. An apparatus for vertically positioning first and second sashes of a window assembly within the window jamb of a window frame, the apparatus comprising:

a cable having a first end supporting the first sash and a second end supporting the second sash;

a pulley supporting the cable;

a housing supporting the pulley for rotation relative to the housing, the housing including a body portion and a vertically extending rib member projecting outward from the body portion, the rib member aligning with a portion of the window jamb to form a substantially continuous jamb wall;

a first bracket attached to the first end of the cable and including an upper end and a lower end;

a second bracket movable relative to the first bracket and configured to support the first sash; and an adjustment member engaging and extending through the lower end of the first bracket and being movable relative to the first bracket to cause corresponding movement of the second bracket relative to the first end of the cable;

wherein the second bracket includes first and second members, the first member being configured to support the sash, the second member being fixed relative to the first member; and wherein the first member slidably engages the first bracket.

4. The apparatus of claim 3, wherein the first bracket includes a post that slidably engages the first member.

5. A self-balanced double-hung window assembly comprising:

a window frame including a dividing member defining a first jamb channel and a second jamb channel;

a first sash movable within the first jamb channel;

a second sash movable within the second jamb channel;

a cable having a first end supporting the first sash and a second end supporting the second sash;

a pulley supporting the cable; and a housing at least partially disposed within the first and second jamb channels and supporting the pulley for rotation relative to the housing such that rotation of the pulley in a first rotational direction causes corresponding movement of the first sash in a first linear direction and corresponding movement of the second sash in a second linear direction, the housing including a body portion and a rib member extending in a vertical direction substantially parallel to the first and second jamb channels, the rib member being aligned with and abutting the dividing member separating the first and second jamb channels;

a first bracket attached to the first end of the cable;

a second bracket movable relative to the first bracket;

wherein the second bracket includes first and second members, the first member being configured to support one of the first and second sashes, the second member being fixed relative to the first member; and wherein the first member slidably engages the first bracket.

6. The assembly of claim 5, wherein the first bracket includes a post that slidably engages the first member.

* * * * *